US009134637B2

(12) United States Patent
Hotta et al.

(10) Patent No.: US 9,134,637 B2
(45) Date of Patent: Sep. 15, 2015

(54) TONER

(71) Applicant: CANON KABUSHIKI KAISHA, Tokyo (JP)

(72) Inventors: Yojiro Hotta, Mishima (JP); Shuhei Moribe, Mishima (JP); Kosuke Fukudome, Tokyo (JP); Satoshi Mita, Mishima (JP); Kazuo Terauchi, Numazu (JP); Tetsuya Ida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/103,836

(22) Filed: Dec. 11, 2013

(65) Prior Publication Data

US 2014/0099578 A1 Apr. 10, 2014

Related U.S. Application Data

(63) Continuation of application No. PCT/JP2013/003787, filed on Jun. 18, 2013.

(30) Foreign Application Priority Data

Jun. 22, 2012 (JP) ..... 2012-141033

(51) Int. Cl.
*G03G 9/087* (2006.01)

(52) U.S. Cl.
CPC ..... *G03G 9/08755* (2013.01); *G03G 9/08795* (2013.01); *G03G 9/08797* (2013.01)

(58) Field of Classification Search
USPC ..... 430/109.1, 109.4
See application file for complete search history.

(56) References Cited

U.S. PATENT DOCUMENTS

| | | | | |
|---|---|---|---|---|
| 7,144,668 | B2 | 12/2006 | Baba et al. | |
| 8,216,754 | B2 | 7/2012 | Ikeda et al. | |
| 8,431,304 | B2 | 4/2013 | Sugimoto et al. | |
| 2011/0262856 | A1 | 10/2011 | Sugimoto et al. | |
| 2011/0305984 | A1* | 12/2011 | Tominaga et al. | 430/108.4 |
| 2012/0052434 | A1* | 3/2012 | Sugimoto et al. | 430/108.8 |
| 2012/0189951 | A1* | 7/2012 | Sugimoto et al. | 430/108.2 |
| 2012/0288299 | A1 | 11/2012 | Uchinokura et al. | |
| 2014/0099577 | A1 | 4/2014 | Moribe et al. | |

FOREIGN PATENT DOCUMENTS

| | | | | |
|---|---|---|---|---|
| JP | 2004-326001 | * | 11/2004 | G03G 9/087 |
| JP | 2005-84226 | A | 3/2005 | |
| JP | 2007-21595 | A | 2/2007 | |
| JP | 2010-38969 | A | 2/2010 | |
| JP | 2010-102058 | A | 5/2010 | |
| JP | 2010-197424 | * | 9/2010 | G03G 15/08 |
| JP | 2011-242750 | A | 12/2011 | |
| JP | 2012-53196 | A | 3/2012 | |
| JP | 2012-98684 | A | 5/2012 | |
| JP | 2012-234103 | A | 11/2012 | |

OTHER PUBLICATIONS

Translation of JP 2010-197424 published Sep. 2010.*
Translation of JP 2004-326001 published Nov. 2004.*
PCT International Search Report and Written Opinion of the International Searching Authority, International Application No. PCT/JP2013/003787, Mailing Date Jul. 16, 2013.
Fedors, "A Method for Estimating Both the Solubility Parameters and Molar Volumes of Liquids", Polymer Engineering and Science, vol. 14, No. 2, 1974, pp. 147-154.
International Preliminary Report on Patentability, International Application No. PCT/JP2013/003787, Mailing Date Dec. 31, 2014.

* cited by examiner

*Primary Examiner* — Peter Vajda
(74) *Attorney, Agent, or Firm* — Fitzpatrick, Cella, Harper and Scinto

(57) ABSTRACT

The toner of the present invention includes toner particles containing polyester resins A and B and a colorant, the A has a polyester portion including a portion capable of forming a crystal structure and a crystal nucleating agent portion, which is bonded to an end of the polyester portion, the B is free from any portions capable of forming a crystal structure, in a chart obtained as a result of GPC of a THF-soluble matter of the B, a ratio of a component having a molecular weight of 1500 or less in the B is 5.0 to 15.0% by area, and when an SP value of the polyester portion of the A is represented by Sa $((cal/cm^3)^{1/2})$ and an SP value of the B is represented by Sb $((cal/cm^3)^{1/2})$, the SP values Sa and Sb satisfy the following relationships:

$$9.50 \leq Sa \leq 11.00$$

$$-0.65 \leq Sb - Sa \leq 0.70.$$

11 Claims, No Drawings

TONER

CROSS-REFERENCE TO RELATED APPLICATIONS

This application is a continuation of International Application No. PCT/JP2013/003787, filed Jun. 18, 2013, which claims the benefit of Japanese Patent Application No. 2012-141033, filed Jun. 22, 2012.

BACKGROUND OF THE INVENTION

1. Field of the Invention

The present invention relates to a toner for use in electrophotography, an image forming method for visualizing an electrostatic charge image and a toner jet.

2. Description of the Related Art

As a general electrophotographic method, a method for obtaining a copied image by forming a latent image on an image carrier (a photosensitive body), visualizing the latent image by supplying a toner thereto, transferring the resulting toner image onto a transfer material such as paper and then fixing the toner image on the transfer material with heat/pressure is known.

In order to reduce the power consumption and shorten the wait time of an electrophotographic apparatus, an on-demand type fixing apparatus obtained by combining a ceramic heater with a small thermal capacity and a film has been put to practical use as a fixing apparatus.

In such a fixing apparatus, attempts have been made to reduce a fixing nip internal pressure thereof from the viewpoint of elongation of the lifetime and applicability to a variety of media.

Furthermore, according to recent increase in a print speed, time when a toner and a medium such as paper pass through a nip of a fixing apparatus has become shorter year by year.

Moreover, there are recently increasing opportunities for a user to output, by using an image forming apparatus such as a laser beam printer (LBP), a graphic image with a high coverage rate such as image data taken through a digital camera, a portable terminal or the like, or a poster.

In this context, there is a demand for a toner capable of showing an excellent low temperature fixing property even under severer fixing conditions, for example, conditions for forming an image with a high coverage rate in a short period of time with a low nip internal fixing pressure.

In order to achieve low temperature fixation by such a fixing apparatus, it is necessary to attain better low temperature fixation of a toner than that of a conventional toner, and there are a large number of reports on use, as a binding resin, of not only an amorphous rein but also a crystalline resin for this purpose.

It is known that a crystalline resin is abruptly molten in the vicinity of its glass transition temperature and can be improved in the low temperature fixing property by increasing compatibility with an amorphous resin (Japanese Patent Application Laid-Open No. 2010-102058).

When the compatibility therebetween is too high, however, there arises a problem in which the resulting toner is degraded in a heat-resistant storage property and crystallizability on the contrary.

In contrast, when the compatibility between an amorphous resin and a crystalline resin is lowered, the crystal of the crystalline resin is liable to be easily formed, but these resins are hard to be compatible with each other even at a temperature over melting points thereof, and hence, it is difficult to improve the low temperature fixing property particularly when a fixing time is short or a nip internal pressure is low.

Meanwhile, it is known that the fixing property and the resistance to deterioration of a toner can be improved by reducing the content of a low molecular weight component in a resin (Japanese Patent Application Laid-Open No. 2005-84226).

If the fixing pressure is low, however, a sufficient fixing property cannot be attained merely by providing a sharp melt property to the resin.

In order to solve this problem, it is known that the low temperature fixing property and glossiness can be improved by causing a toner to contain amorphous polyester including a small amount of low molecular weight component and crystalline polyester (Japanese Patent Application Laid-Open No. 2007-21595).

If the toner merely contains the amorphous polyester and the crystalline polyester, however, the amorphous polyester and the crystalline polyester become compatible with each other when the toner is molten in a fixing step. As a result, the toner present in a fixed image becomes more plasticized than necessary, and the toner image resulting from fixing may be blocked in some cases under a severe environment of a high temperature and high humidity.

In this manner, there still remains a large number of technical problems for attaining both an excellent low temperature fixing performance and long-term storage stability of a fixed image under a high temperature environment, and there still is room for further improvement.

SUMMARY OF THE INVENTION

The present invention is directed to providing a toner capable of overcoming the aforementioned problems.

Further, the present invention is directed to providing a toner that shows a good fixing property on thick paper, forms an image stable even in long term storage, and shows little glossiness unevenness after fixing even in using a system in which a fixer having a structure with a low fixing nip internal pressure is used and rapid development is performed.

According to one aspect of the present invention, there is provided a toner comprising toner particles, each of which contains a polyester resin A, a polyester resin B and a colorant, wherein the polyester resin A has a polyester portion including a portion capable of forming a crystal structure and a crystal nucleating agent portion, which is bonded to an end of the polyester portion, the polyester resin B is a resin which is free from any portions capable of forming a crystal structure, in a chart obtained by measuring a molecular weight distribution of a tetrahydrofuran (THF)-soluble matter of the polyester resin B by gel permeation chromatography (GPC), a ratio of a component having a molecular weight of 1500 or less is 5.0% by area or more and 15.0% by area or less, and when an SP value of the polyester portion of the polyester resin A is represented by Sa $((cal/cm^3)^{1/2})$ and an SP value of the polyester resin B is represented by Sb $((cal/cm^3)^{1/2})$, the SP values Sa and Sb satisfy the following relationships:

$$9.50 \leq Sa \leq 11.00$$

$$-0.65 \leq Sb - Sa \leq 0.70.$$

DESCRIPTION OF THE EMBODIMENTS

Preferred embodiments of the present invention will now be described in detail in accordance with the accompanying drawings.

In a toner of the present invention, as the temperature rises by heating in a fixing operation, the existing states of a polyester resin A and a polyester resin B are rapidly changed. Owing to this rapid change in the existing states, the effects of the present invention can be achieved. The detail will now be described.

The polyester resin A is a resin having a polyester portion including a portion capable of forming a crystal structure, and is molten when heated to a temperature over a melting point of the crystal structure portion, so as to show a plasticizing effect for the polyester resin B. As a result, the low temperature fixing property of the toner can be improved. When the polyester resin A and the polyester resin B become compatible with each other by heating to a temperature over the melting point of the polyester resin A, a glass transition temperature (Tg) of the whole toner is largely lowered and the melt viscosity is also lowered. Therefore, it is necessary, in a fixing operation, to place the both resins in a state where the resins can be completely compatible with each other.

On the other hand, if the polyester resin A and the polyester resin B are compatible with each other at room temperature, the storage property of the toner or a fixed image in a high temperature environment is degraded. Therefore, it is significant to make these resins have a phase separation structure at room temperature.

Accordingly, the toner containing the polyester resin A having a portion capable of forming a crystal structure and the polyester resin B which is free from any portions capable of forming a crystal structure is required to satisfy the following characteristics:

i) In the toner before use for forming an image, the polyester resin A and the polyester resin B are in a phase separation state;

ii) in a fixing operation, the polyester resin A and the polyester resin B are in a compatible state; and iii) after the fixing operation, the polyester resin A and the polyester resin B rapidly restore to a structure of the phase separation state.

The toner of the present invention is a toner that satisfies the aforementioned characteristics, and in which transition between the phase separation state at room temperature and the compatible state at a high temperature can be reversibly and rapidly caused.

For this purpose, it is significant that the polyester portion of the polyester resin A is a crystalline resin having high crystallinity and that SP values of the polyester portion of the polyester resin A and the polyester resin B fall in prescribed ranges.

Furthermore, a polyester resin has a distribution in its molecular weight, and a low molecular weight component of the resin is easily thermally molten and shows a plasticizing effect in a fixing operation but is difficult to form a phase separation structure at room temperature. In other words, the low molecular weight component unavoidably affects the reversible phase transition. Accordingly, it is also significant to make the content of a low molecular weight component in the polyester resin B fall in a prescribed range.

The polyester portion of the polyester resin A used in the present invention is a resin with high crystallinity having an SP value Sa ($(cal/cm^3)^{1/2}$) of 9.50 or more and 11.00 or less. The SP value Sa is preferably 9.50 or more and 10.70 or less, and more preferably 9.80 or more and 10.40 or less. In the polyester resin A, a low SP value means that the number of carbon atoms of aliphatic carboxylic acid and/or aliphatic alcohol contained as a copolymeric component in the polyester resin A is large.

In order to attain high crystallinity, the number of carbon atoms can be larger, namely, the SP value can be lower, but if the SP value of the polyester portion of the polyester resin A is too low, the compatibility with the polyester resin B attained in a fixing temperature region is degraded. Therefore, if the SP value Sa is lower than 9.50, phase separation from the polyester resin B is caused even in a fixing operation, and hence, the low temperature fixing property (high speed fixing property) is degraded in a rapid development system. On the other hand, if the SP value Sa is higher than 11.00, the compatibility with the polyester resin B is so large that the storage property of a fixed image at a high temperature is degraded. Besides, an image is easily peeled off when the image is bent.

This is probably for the following reason: If the toner is present in a fixed image in a compatible state, the Tg of the toner present in the fixed image is lowered, and therefore, the melt viscosity of the toner present in the image is rather lowered in a high temperature environment. As a result, when the image is bent, adhesive force between paper and the toner is lowered and hence the toner is easily peeled off.

Incidentally, an SP value employed in the present invention is calculated on the basis of the kinds and proportions of monomers contained in a resin according to a generally employed method of which some are described in Fedors [Poly. Eng. Sci., 14 (2) 147 (1974)], such as Dunkel, Bowden and Jones, Small, and Rheineck and Lin.

Furthermore, in order to increase the crystallinity of the polyester portion of the polyester resin A, it is necessary to provide a crystal nucleating agent portion by bonding a crystal nucleating agent to an end of the polyester portion.

In general, a crystal portion is known to be formed when crystal grows after a crystal nucleus is formed. Since the crystal nucleating agent is bonded to the end of a polyester molecular chain, crystal growth of the portion, of the polyester resin A, capable of forming a crystal structure (hereinafter sometimes referred to as the "portion a") can be accelerated, and the speed of crystallization can be improved.

If no crystal nucleating agent is bonded, the speed of the crystal growth of the portion a is so low that the reversible phase transition structure cannot be attained. Alternatively, if a crystal nucleating agent is present in a polymer without bonding thereto, since the crystal nucleating agent generally has a low molecular weight, the agent is liable to deposit on the surface of the toner, and hence, the heat-resistant storage property of the toner is degraded.

A nucleating agent used for forming the crystal nucleating agent segment is not especially limited as long as the crystal nucleating agent is a compound having a higher crystallization speed than the segment a. However, from the viewpoint of a high crystallization speed, a compound that has a principal chain containing a hydrocarbon segment and has one or more functional groups reactive with the end of the polyester resin portion is preferably used. A compound that has a linear hydrocarbon segment and has one functional group reactive with the polyester resin portion is more preferably used. From the viewpoint of improvement in reactivity between the crystal nucleating agent and the end of the polyester resin portion, the molecular weight of the crystal nucleating agent is preferably 100 to 10,000 and more preferably 150 to 5,000.

The nucleating agent is not especially limited as long as the crystal nucleating agent can be bonded to the end of the polyester resin portion, and can be an aliphatic carboxylic acid having 10 or more and 30 or less carbon atoms and/or an aliphatic alcohol having 10 or more and 30 or less carbon atoms. This is preferable because the crystallinity of the crystal nucleating agent can be increased when the crystal nucleating agent has a given number or more carbon atoms. Further, this is preferable because it provides higher molecular mobility than the segment a of the polyester resin A and can increase the crystallization speed as the crystal nucleus.

From the viewpoint of the improvement of the crystallization speed, the amount of the crystal nucleating agent added can be contained in the polyester resin A in a content of 0.1 part by mol or more and 7.0 parts by mol or less, and preferably 0.2 part by mol or more and 5.0 parts by mol or less based on 100 parts by mol of raw material monomers. When the content falls in the aforementioned range, the compatibility of the polyester resin A and the polyester resin B can be appropriately adjusted, and the image storage property of a fixed image can be sufficiently improved.

It was determined through the following analysis whether or not the crystal nucleating agent is bonded to the polyester portion.

A sample solution was prepared by precisely weighing 2 mg of a sample of the polyester resin A and dissolving the weighed sample in 2 ml of chloroform added thereto. The polyester resin A corresponding to a raw material of the toner is used as a resin sample, but if the polyester resin A is not easily available, a toner containing the polyester resin A can be used instead as the sample.

Next, a matrix solution was prepared by precisely weighing 20 mg of 2,5-dihydroxybenzoic acid (DHBA) and dissolving the weighed DHBA in 1 ml of chloroform added thereto.

Furthermore, an ionization assistant solution was prepared by precisely weighing 3 mg of Na trifluoroacetate (NaTFA) and dissolving the weighed NaTFA in 1 ml of acetone added thereto.

A measurement sample was obtained by mixing 25 μl of the sample solution, 50 μl of the matrix solution and 5 μl of the ionization assistant solution thus prepared, dropping the resulting mixture onto a sample plate for an MALDI analysis and drying the dropped mixture.

A mass spectrum was obtained by using MALDI-TOFMS (manufactured by Bruker Daltonics, Reflex III) as an analyzer.

In the thus obtained mass spectrum, assignment of respective peaks in an oligomer region (with m/Z of 2000 or less) was obtained, so as to determine by confirming whether or not there is a peak corresponding to a composition of the crystal nucleating agent bonded to a molecular end.

In order to obtain a structure in which the reversible phase transition can be caused in the polyester resin A and the polyester resin B, it is necessary, in addition to the use of the crystal nucleating agent, that the polyester portion of the polyester resin A and the polyester resin B have SP values falling in the prescribed ranges. Specifically, when an SP value of the polyester portion of the polyester resin A is represented by Sa and an SP value of the polyester resin B is represented by Sb, it is significant that the SP values Sa and Sb satisfy the following relationship:

$$-0.65 \leq Sb - Sa \leq 0.70 \quad \text{Formula 1}$$

Furthermore, the SP value Sa of the polyester portion of the polyester resin A and the SP value Sb of the polyester resin B preferably satisfy a relationship of:

$$-0.55 \leq Sb - Sa \leq 0.70$$

and more preferably satisfy a relationship of:

$$-0.50 \leq Sb - Sa \leq 0.50$$

A difference in the SP value (Sb−Sa) is an index corresponding to easiness in making the polyester resin A and the polyester resin B compatible with each other when thermally molten and in causing phase separation therein at room temperature.

Even when the crystal nucleating agent is bonded to the end of the polyester molecular chain in the polyester resin A, if the relationship of Formula 1 is not satisfied, the reversible phase transition structure cannot be attained.

An SP value (solubility parameter) is conventionally used as an index corresponding to easiness in mixing resins or mixing a resin and a wax, or the like. In order to attain the reversible phase transition structure as in the toner of the present invention, it is necessary not only to bond the crystal nucleating agent but also to set the difference in the SP value between the polyester resin A and the polyester resin B to a specific value.

If the difference in the SP value falls in the aforementioned range, the compatibility and the phase separation are properly balanced, and therefore, low temperature fixation can be excellently attained in a fixing operation, and furthermore, after forming a fixed image, even when the fixed image is left to stand in a high temperature environment for a long period of time, the image can be excellently stored.

Furthermore, in a chart obtained by measuring a molecular weight distribution of a tetrahydrofuran (THF)-soluble matter of the polyester resin B by gel permeation chromatography (GPC), it is significant that a ratio of a component having a molecular weight of 1500 or less is 5.0% by area or more and 15.0% by area or less. The ratio can be 9.0% by area or more and 13.0% by area or less.

This low molecular weight component (that is, a component having a molecular weight of 1500 or less) is a component that can be easily produced, in polymerizing the polyester resin, if reactivity is different between an acid and an alcohol component.

The content of the low molecular weight component can be controlled according to a monomer composition and polymerization conditions. The controlling method is not especially limited as long as a desired low molecular weight can be attained, and examples of the method include the following: A method in which the polymerization condition at the beginning is changed for accelerating an esterification reaction for causing a reaction between an acid and an alcohol monomer; a method in which a water content in the reaction system for suppressing a polycondensation reaction is controlled; and a method in which a monomer species is changed.

Such a low molecular weight component has a low glass transition temperature. Therefore, since this component shows a plasticizing effect for the toner in a fixing operation, if the ratio of the component having the molecular weight of 1500 or less exceeds 15.0% by area, glossiness unevenness is easily caused in a fixed image. This low molecular weight component is a component that can be easily thermally molten, and hence is easily unevenly distributed in a fixing operation. This seems to be a reason why glossiness unevenness is easily caused on thick paper with a small quantity of heat in using a fixer with a low pressure.

On the other hand, if the ratio of the component having the molecular weight of 1500 or less is smaller than 5.0% by area, it is difficult to attain a plasticizing effect, and hence a fixing property on thick paper is liable to degrade. On thick paper, a quantity of heat for melting a toner layer in a fixing operation is small, and therefore, a sufficient fixing property is difficult to attain merely with the compatible function of the polyester resins.

Furthermore, according to the examination made by the present inventors, if the low molecular weight component has a specific composition, the compatibility with a portion having a crystal structure can be improved, so that the fixing property can be effectively improved. Specifically, a difference between an SP value Sc of the low molecular weight component and the SP value Sa of the polyester portion of the polyester resin A having crystallizability can satisfy the following relationship:

$$-0.50 \leq Sa - Sc \leq 0.50.$$

The polyester resin A is not especially limited as long as the crystal nucleating agent portion is bonded to the end of the polyester portion thereof and the polyester portion includes a portion capable of forming a crystal structure.

Incidentally, a resin including a portion capable of forming a crystal structure herein means a resin having, when formed into a crystal structure, an endothermic peak in temperature rise and an exothermic peak in temperature fall in measurement with a differential scanning calorimeter (DSC). The measurement of an endothermic peak is performed according to the measurement method of "ASTM D3418-82".

Examples of an alcohol component usable in synthesizing the polyester portion contained in the polyester resin A include the following compounds.

An alcohol component used as a raw material monomer includes aliphatic diols having 6 to 18 carbon atoms from the viewpoint of increasing the crystallizability of the polyester molecular chain.

Examples of the aliphatic diols having 6 to 18 carbon atoms include 1,6-hexanediol, 1,7-heptanediol, 1,8-octanediol, 1,9-nonanediol, 1,10-decanediol, 1,11-undecanediol and 1,12-dodecanediol. Among these, aliphatic diols having 6 to 12 carbon atoms can be suitably used from the viewpoint of the fixing property and the heat-resistant stability.

The content in the alcohol component of the aliphatic diols having 6 to 18 carbon atoms can be 80 to 100 mol % from the viewpoint of further increasing the crystallizability.

Examples of a polyvalent alcohol component, other than the aliphatic diols having 6 to 18 carbon atoms, usable as the alcohol component include aromatic diols such as an alkyleneoxide addition product of bisphenol A represented by the following formula (I), including a polyoxypropylene addition product of 2,2-bis(4-hydroxyphenyl)propane and a polyoxyethylene addition product of 2,2-bis(4-hydroxyphenyl)propane; and tri- or more-valent alcohols such as glycerin, pentaerythritol and trimethylolpropane:

Formula 1

(I)

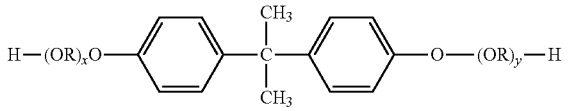

wherein R represents an alkylene group having 2 or 3 carbon atoms, x and y each represent a positive number, and a sum of x and y is 1 to 16 and preferably 1.5 to 5.

Examples of an acid component usable for synthesizing the polyester portion contained in the polyester resin A include the following compounds.

As a carboxylic acid component used as a raw material monomer, from the viewpoint of improving the crystallizability of the polyester, aliphatic dicarboxylic acid compounds having 6 to 18 carbon atoms can be used.

Examples of the aliphatic dicarboxylic acid compounds having 6 to 12 carbon atoms include 1,8-octanedioic acid, 1,9-nonanedioic acid, 1,10-decanedioic acid, 1,11-undecanedioic acid and 1,12-dodecanedioic acid. Among these, aliphatic dicarboxylic acid compounds having 6 to 12 carbon atoms can be suitably used from the viewpoint of the fixing property and the heat-resistant stability of the toner.

The content of the aliphatic dicarboxylic acid compound having 6 to 18 carbon atoms in the carboxylic acid component can be 80 to 100 mol %.

In the present invention, a carboxylic acid component other than the aliphatic dicarboxylic acid compounds having 6 to 18 carbon atoms can be used together. Examples include, but are not limited to, aromatic dicarboxylic acid compounds and aromatic polycarboxylic acid compounds having three or more valence.

The aromatic dicarboxylic acid compounds include aromatic dicarboxylic acid derivatives that can form, through condensation, a constitutional unit the same as a constitutional unit derived from an aromatic dicarboxylic acid. Specific examples of the aromatic dicarboxylic acid compounds include aromatic dicarboxylic acids such as phthalic acid, isophthalic acid and terephthalic acid, anhydrides of these acids, and alkyl (having 1 to 3 carbon atoms) esters thereof. Examples of an alkyl group contained in the alkyl esters include a methyl group, an ethyl group, a propyl group and an isopropyl group.

Examples of the polycarboxylic acid compounds having three or more valence include aromatic carboxylic acids such as 1,2,4-benzenetricarboxylic acid (trimellitic acid), 2,5,7-naphthalenetricarboxylic acid and pyromellitic acid, and anhydrides of these acids, and derivatives thereof such as alkyl (having 1 to 3 carbon atoms) esters.

A molar ratio between the alcohol component and the carboxylic acid component (carboxylic acid component/alcohol component) used as the raw material monomers for the polycondensation reaction can be 0.80 or more and 1.20 or less.

The polyester resin A of the present invention can have a quantity of heat of fusion (ΔH), obtained based on an area of an endothermic peak observed in temperature rise in measurement with a differential scanning calorimeter (DSC), of 100 Jig or more and 140 Jig or less.

Furthermore, when the polyester resin A has a softening point TmA (° C.) and the polyester resin B has a softening point TmB (° C.), the softening points TmA and TmB preferably satisfy the following relationships:

$$-10 \leq TmB - TmA \leq 40$$

$$60 \leq TmA \leq 90$$

More preferably, the softening point TmA is 70° C. or more and 85° C. or less. The softening points are preferably in such relationships from the viewpoint of further improving fixing unevenness at a low pressure and a fixing property on thick paper.

Furthermore, the acid value of the polyester resin A can be 2 mg KOH/g or more and 40 mg KOH/g or less from the viewpoint of attaining a good charging characteristic of the toner.

The hydroxyl value of the polyester resin A can be 2 mg KOH/g or more and 40 mg KOH/g or less from the viewpoint of the fixing property and the storage stability.

As the polyester resin B used in the toner of the present invention, any polyester obtained by a general producing method may be used as long as the SP value and the ratio of the molecular weight of 1500 or less can be set to desired values.

As a bivalent alcohol component, alkyleneoxide addition products of bisphenol A represented by the above formula (I) including a polyoxypropylene addition product of 2,2-bis(4-hydroxyphenyl)propane and a polyoxyethylene addition product of 2,2-bis(4-hydroxyphenyl)propane, ethylene glycol, 1,3-propylene glycol and neopentyl glycol may be used.

As a tri- or more-valent alcohol component, sorbitol, pentaerythritol and dipentaerythritol may be used, for example.

For obtaining the polyester resin B applicable to the present invention, one of these bivalent alcohol components and the tri- or more-valent alcohol components can be singly used, or a plurality of such monomers can be used.

Examples of a bivalent carboxylic acid component as an acid component include maleic acid, fumaric acid, phthalic acid, isophthalic acid, terephthalic acid, succinic acid, adipic acid, n-dodecenylsuccinic acid, and anhydrides or lower alkyl esters of these acids.

Examples of a polyvalent carboxylic acid component having three or more valence include 1,2,4-benzenetricarboxylic acid, 2,5,7-naphthalenetricarboxylic acid, pyromellitic acid, EMPOL trimer acid, and anhydrides or lower alkyl esters of these acids.

The method for producing the polyester is not especially limited, and the polyester can be produced by performing an esterification reaction or an ester-exchange reaction by using any of the aforementioned monomers. In polymerizing a raw material monomer, a generally used esterification catalyst or the like such as dibutyltin oxide may be appropriately used for accelerating the reaction.

The glass transition temperature (Tg) of the polyester resin B can be 45° C. or more and 70° C. or less from the viewpoint of the fixing property and the storage property.

The softening point TmB of the polyester resin B can be 80° C. or more and 130° C. or less and preferably 90° C. or more and 120° C. or less from the viewpoint of the low temperature fixing property of the toner.

Furthermore, the acid value of the polyester resin B can be 2 mg KOH/g or more and 40 mg KOH/g or less from the viewpoint of attaining a good charging characteristic of the toner. The hydroxyl value can be 2 mg KOH/g or more and 70 mg KOH/g or less from the viewpoint of the fixing property and the storage stability.

Furthermore, a mass ratio between the polyester resin A and the polyester resin B is preferably 5:95 to 40:60 from the viewpoint of the low temperature fixing property and the long-term storage stability of an image in a high temperature environment. The mass ratio is more preferably 10:90 to 30:70.

Besides, a weight average molecular weight Mwb of the tetrahydrofuran (THF)-soluble matter of the polyester resin B obtained by the gel permeation chromatography (GPC) can be 3000 or more and 100,000 or less.

The toner of the present invention containing the polyester resin A and the polyester resin B has a phase separation structure at room temperature. Accordingly, various properties exhibited by the toner can have apparently similar values to those of toner properties of a toner having a phase separation structure.

The softening point (TmB) of the toner can be 80° C. or more and 120° C. or less from the viewpoint of the low temperature fixing property of the toner. It is more preferably 90° C. or more and 100° C. or less.

In the present invention, the polyester resin A and the polyester resin B work as a binding resin, but any of known resins may be added as another toner binding resin as long as the effects of the present invention are not impaired.

In the present invention, for providing the releasability to the toner, a wax may be used in the toner as occasion demands.

As the wax, hydrocarbon wax such as low molecular weight polyethylene, low molecular weight polypropylene, microcrystalline wax or paraffin wax can be used because of good dispersibility in the toner and high releasability. A small quantity of one or two or more waxes may be used together if necessary.

Specific examples include the following: Biscol (registered trademark) 330-P, 550-P, 660-P and TS-200 (manufactured by Sanyo Chemical Industries, Ltd.), Hi-wax 400P, 200P, 100P, 410P, 420P, 320P, 220P, 210P and 110P (manufactured by Mitsui Chemicals, Inc.), Sasol H1, H2, C80, C105 and C77 (manufactured by Schumann Sasol Ltd.), HNP-1, HNP-3, HNP-9, HNP-10, HNP-11 and HNP-12 (manufactured by Nippon Seiro Co., Ltd.), Unilin (registered trademark) 350, 425, 550 and 700, Unicid (registered trademark) 350, 425, 550 and 700 (manufactured by Toyo Petrolite Co., Ltd.), haze wax, bees wax, rice wax, candelilla wax and carnauba wax (available from Cerarica Noda Co., Ltd.).

With respect to the timing at which the wax is added, the wax may be added at the time of melting/kneading during the production of the toner or at the time of preparing the polyester resin B, and the adding method is appropriately selected from existing methods. Besides, one of these waxes may be singly used or a plurality of these may be used together.

The wax can be added in a content of 1 part by mass or more and 20 parts by mass or less based on 100 parts by mass of the binding resin.

The toner of the present invention may be a magnetic toner or a non-magnetic toner. When used as a magnetic toner, magnetic iron oxide can be used. As the magnetic iron oxide, iron oxide such as magnetite, maghemite or ferrite is used. For purposes of improving the fine dispersibility of the magnetic iron oxide in the toner particles, the magnetic iron oxide can be subjected to a treatment to loosen the magnetic iron oxide once by shearing a slurry used in the preparation.

In the present invention, the content of the magnetic iron oxide contained in the toner is preferably 25% by mass or more and 45% by mass or less, and more preferably 30% by mass or more and 45% by mass or less in the toner.

When the toner is used as a non-magnetic toner, one, two or more of all the conventionally known pigments and dyes, such as carbon black, can be used as a colorant.

The content of the colorant is preferably 0.1 part by mass or more and 60.0 parts by mass or less and more preferably 0.5 part by mass or more and 50.0 parts by mass or less based on 100.0 parts by mass of the resin component.

In the toner of the present invention, a flow improver that has a high ability to imparting fluidity to the surfaces of the toner particles can be used as an inorganic fine powder. As the flow improver, any one whose external addition can increase the fluidity as compared with that attained before the addition can be used. Examples include the following: A fluorine-based resin powder such as a vinylidene fluoride fine powder or a polytetrafluoroethylene fine powder; fine powder silica such as wet process silica or dry process silica, and treated silica obtained by subjecting such silica to a surface treatment with a silane coupling agent, a titanium coupling agent, silicone oil or the like. Preferable examples of the flow improver include a fine powder produced by vapor phase oxidation of a silicon halogen compound, referred to as dry process silica or fumed silica. An example of such silica is one obtained by a pyrogenic oxidation reaction, performed in oxygen or hydrogen, of a silicon tetrachloride gas, and is obtained through the following reaction formula:

$$SiCl_4+2H_2+O_2 \rightarrow SiO_2+4HCl$$

Alternatively, in this preparation process, the flow improver may be a composite fine powder of another metal oxide and silica, which is obtained by using, another metal halogen compound, such as aluminum chloride or titanium chloride, together with a silicon halogen compound.

Furthermore, a treated silica fine powder, which is obtained by a hydrophobization treatment of a silica fine powder produced by vapor phase oxidation of the silicon halogen compound, is suitably used. The silica fine powder can be treated particularly so that the degree of hydrophobization, measured by a methanol titration test, of the treated silica fine powder can be a value of 30 or more and 98 or less.

As a method of the hydrophobization, the hydrophobization is imparted by a chemical treatment performed by using an organic silicon compound reactive with or physically adsorbed on the silica fine powder. As a preferred method, a silica fine powder produced by the vapor phase oxidation of a silicon halogen compound is treated with an organic silicon compound. Examples of such a organic silicon compound include the following: hexamethyldisilazane, trimethylsilane, trimethylchlorosilane, trimethylethoxysilane, dimethyldichlorosilane, methyltrichlorosilane, allyl dimethylchlorosilane, allyl phenyl dichlorosilane, benzyl dimethylchlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethyl ethoxysilane, dimethyl dimethoxysilane, diphenyl diethoxysilane, 1-hexamethyldisiloxane, 1,3-divinyltetramethyldisiloxane, 1,3-diphenyltetramethyldisiloxane, and dimethyl polysiloxane having 2 to 12 siloxane units per molecule and having, in the unit positioned at each end, one hydroxyl group bonded to Si. One of these compounds is singly used or two or more of them are used as a mixture.

The silica fine powder can be subjected to a treatment with silicone oil or to the aforementioned hydrophobization treatment as well.

As a preferred silicone oil, one having viscosity at 25° C. of 30 $mm^2/s$ or more and 1000 $mm^2/s$ or less is used. For example, dimethyl silicone oil, methylphenyl silicone oil, α-methyl styrene-modified silicone oil, chlorophenyl silicone oil and fluorine-modified silicone oil are particularly preferred.

Examples of a method for treating the silicone oil include the following: A method in which a silica fine powder having been treated with a silane coupling agent and silicone oil are directly mixed with each other by using a mixer such as a Henschel mixer; and a method in which silicone oil is sprayed onto a silica fine powder used as a base. Another example include a method in which silicone oil is dissolved or dispersed in an appropriate solvent, a silica fine powder is added thereto and mixed, and the solvent is removed. More preferably, silicone oil-treated silica is heated, after the treatment with the silicone oil, at a temperature of 200° C. or more (more preferably 250° C. or more) in an inert gas for stabilizing a coat formed on the surface thereof.

A preferred silane coupling agent includes hexamethyldisilazane (HMDS).

In the present invention, a method in which silica precedently treated with a coupling agent is treated with silicone oil or a method in which silica is treated simultaneously with a coupling agent and silicone oil can be suitably employed.

The content of the inorganic fine powder is preferably 0.01 part by mass or more and 8.0 parts by mass or less and more preferably 0.10 part by mass or more and 4.00 parts by mass or less based on 100.00 parts by mass of the toner particles.

The toner of the present invention may further contain another external additive if necessary. Examples of the additive include a charge assisting agent, a conductivity imparting agent, a fluidity imparting agent, a caking preventing agent, a release agent to be used in heat roller fixing, a lubricant, and resin fine particles or inorganic fine particles working as an abrasive.

Examples of the lubricant include a polyfluoroethylene powder, a zinc stearate powder and a polyvinylidene fluoride powder. Especially, a polyvinylidene fluoride powder is suitably used. Examples of the abrasive include a cerium oxide powder, a silicon carbide powder and a strontium titanate powder. These external additives are sufficiently mixed by using a mixer such as a Henschel mixer for obtaining the toner of the present invention.

The toner of the present invention may be used as a one-component developer but can be mixed with a magnetic carrier to be used as a two-component developer.

As the magnetic carrier, any of generally known carriers including the following can be used: Magnetic substances such as an iron powder having an oxidized or unoxidized surface; particles of metals such as iron, lithium, calcium, magnesium, nickel, copper, zinc, cobalt, manganese and rare earths, and particles of alloys and oxides of these metals; and ferrite, and a magnetic substance dispersed resin carrier (what is called a resin carrier) containing a magnetic substance and a binder resin for holding the magnetic substance in a dispersed state.

If the toner of the present invention is mixed with a magnetic carrier to be used as a two-component developer, the mixing ratio of the magnetic carrier can be 2% by mass or more and 15% by mass or less in terms of a toner concentration in the developer.

A method for producing the toner of the present invention is not especially limited, but from the viewpoint of obtaining a toner having a better low temperature fixing property, the production method can employ a grinding method including a preparation step in which the polyester resin A and the polyester resin B are molten/kneaded and solidified by cooling.

The shearing can be performed at the time of melting/kneading because thus, the molecular chain of the polyester resin A can easily get into the polyester resin B, and hence, the resins can be made uniformly compatible with each other in melting, resulting in improving the low temperature fixing property.

In conventional technique, if the grinding method is employed, the crystallizability of the polyester resin A and the compatibility of the polyester resin A and the polyester resin B cannot be sufficiently controlled. Therefore, when the resins once become compatible with each other, it is difficult to form a crystal portion in the toner.

In the toner of the present invention, however, owing to the crystal nucleating agent bonded to the end of the molecule of the polyester resin A, and the control of the difference in the SP value between the polyester resin A and the polyester resin B and the molecular weight of the polyester resin B, the reversible phase transition can be caused to obtain a desired toner.

In a material mixing process, the polyester resin A, the polyester resin B, the colorant and the other additives and the like are weighed in prescribed amounts, as materials for the toner particles, to be blended and mixed. Examples of a mixer include a double cone mixer, a V-type mixer, a drum-type mixer, a Super mixer, a Henschel mixer, a Nauta mixer and Mechano Hybrid (manufactured by Nippon Coke & Engineering Co., Ltd.).

Next, the mixed materials are molten and kneaded so as to disperse the colorant and the like in the polyester resins. In the melting/kneading process, a pressure kneader, a batch kneader such as a Banbury mixer, or a continuous kneading machine can be used. Owing to an advantage that continuous production can be performed, a single-screw or double-screw extruder is mainly used. Examples include a KTK double-screw extruder (manufactured by Kobe Steel, Ltd.), a TEM double-screw extruder (manufactured by Toshiba Machine Co., Ltd.), a PCM kneader (manufactured by Ikegai Ltd.), a double-screw extruder (manufactured by KCK Corporation), a Ko-kneader (manufactured by Buss Co., Ltd.) and a Kneadex (manufactured by Nippon Coke & Engineering Co., Ltd.). Furthermore, a resin composition resulting from the melting/kneading may be rolled out by two rolls or the like and cooled with water or the like in a cooling process.

Subsequently, the cooled resin composition is ground in a grinding process into a desired particle size. In the grinding process, the composition is first roughly ground by using, for example, a grinder such as a crusher, a hammer mill or a feather mill, and then finely ground by using, for example, a Criptron system (manufactured by Kawasaki Heavy Industries, Ltd.), a Super Rotor (manufactured by Nisshin Engineering Inc.) a Turbo mill (manufactured by Turbo Kogyo Co., Ltd.) or an air-jet type pulverizing mill.

Subsequently, the thus obtained ground product is classified, as occasion demands, by using a classifier or a screen classifier, such as Elbow-Jet (manufactured by Nittetsu Mining Co., Ltd.) employing an inertial classification system, Turboplex (manufactured by Hosokawa Micron Corporation) employing a centrifugal classification system, a TSP separator (manufactured by Hosokawa Micron Corporation) or Faculty (manufactured by Hosokawa Micron Corporation), and thus, the toner particles are obtained.

After the grinding, a surface treatment for the toner particles such as a spheroidizing treatment can be performed, if necessary, by using a hybridization system (manufactured by Nara Machinery Co., Ltd.), a mechanofusion system (manufactured by Hosokawa Micron Corporation), Faculty (manufactured by Hosokawa Micron Corporation) or Meteo Rainbow MR type (manufactured by Nippon Pneumatic Mfg. Co., Ltd.).

Furthermore, a desired additive can be sufficiently mixed by using a mixer such as a Henschel mixer as occasion demands to obtain the toner of the present invention.

The physical properties of the resins and the toner of the present invention are measured as follows. Examples described later were based on the following measurement methods.

<Measurement of Molecular Weight by GPC>

A column is stabilized in a heat chamber at 40° C., and THF used as a solvent is flown to the column at this temperature at a flow rate of 1 ml/min, and then, approximately 100 μl of a THF sample solution is injected for measurement. In the measurement of the molecular weight of a sample, a molecular weight distribution of the sample was calculated based on a relationship between counted values and logarithms of a calibration curve created by using several monodisperse polystyrene standard samples. As the standard polystyrene samples used for creating the calibration curve, those having a molecular weight of approximately $10^2$ to $10^7$ manufactured by Tosoh Corporation or Showa Denko K.K. are used, and it is appropriate to use at least 10 standard polystyrene samples. Besides, an RI (refractive index) detector is used as a detector. Incidentally, a combination of a plurality of commercially available polystyrene gel columns may be used as the column, and examples of the combination include a combination of shodex GPC KF-801, 802, 803, 804, 805, 806, 807 and 800P manufactured by Showa Denko K.K., and a combination of TSKgel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guard column manufactured by Tosoh Corporation.

Furthermore, a sample is prepared as follows.

After putting a sample in THF, the resultant is left to stand at 25° C. for several hours, and then sufficiently shook for well mixing the sample with THF (until a coalesced product of the sample is lost), and the resultant is left to stand another 12 hours or more. At that time, a time duration in which the sample is left to stand in the THF is adjusted to be 24 hours in total. Thereafter, the resulting solution is allowed to pass through a sample treatment filter (having a pore size of 0.2 μm or more and 0.5 μm or less, such as a Mishoridisk H-25-2 (manufactured by Tosoh Corporation)) so as to obtain a filtrate as a sample for the GPC. Furthermore, the concentration of the sample is adjusted to have a resin component of 0.5 mg/ml or more and 5.0 mg/ml or less.

The weight average molecular weight, the number average molecular weight and the ratio of the component having the molecular weight of 1500 or less were measured by the aforementioned method.

Incidentally, the ratio of the component having a molecular weight of 1500 or less corresponds to an area ratio of a region corresponding to a molecular weight of 1500 or less in a graph created with a molecular weight indicated by the abscissa, expressed as a logarithm, and with a signal intensity (mV) from an RI detector indicated by the ordinate.

<Analysis of Low Molecular Weight Component Contained in Resin>

First, 100 mg of a resin sample is dissolved in 3 ml of chloroform. The resulting sample solution is subjected to suction filtration by using a syringe equipped with a sample treatment filter (having a pore size of 0.2 μm or more and 0.5 μm or less, which can be a Mishoridisk H-25-2 (manufactured by Tosoh Corporation) or the like) so as to remove an insoluble matter. The thus obtained soluble matter is introduced into preparative HPLC (using an apparatus, LC-9130 NEXT manufactured by Japan Analytical Industry Co., Ltd., exclusion limit of sample columns: 20000 and 70000, connected in series), and a chloroform eluent is supplied at a flow rate of 3.5 ml. When a peak is found in the thus obtained chromatograph, a portion after the retention time corresponding to a molecular weight of 1500 of a monodisperse polystyrene standard sample is dispensed.

The dispensed solution is distilled under reduced pressure for removing a solvent, and the resultant is vacuum dried for 8 hours so as to be used as a sample. To the thus obtained sample, deuterated chloroform is added, and the resultant is put in an NMR sample tube to be used as an NMR measurement sample. NMR (using an apparatus, Bruker AVANCE III, 500 MHz) is employed for measuring a proton spectrum. Assignment of monomer-derived peaks is obtained, so as to calculate, based on integrated values of the respective monomer-derived peaks, a molar ratio in the resin of a component having a molecular weight of 1500 or less.

<Measurement of Melting Points and Quantity of Heat of Fusion of Polyester Resin and Wax>

In a DSC curve measured, for each of a polyester resin and a wax, according to ASTM D3418-82 by using a differential scanning calorimeter "Q2000" (manufactured by TA Instruments Inc.), a peak temperature of the maximum endothermic peak is defined as a melting point, and the quantity of heat obtained based on the area of the peak is defined as the quantity of heat of fusion.

For temperature correction for a detection unit of the used apparatus, melting points of indium and zinc are used, and for correction of the quantity of heat, the heat of fusion of indium is used. Specifically, approximately 2 mg of a sample is precisely weighed and the weighed sample is put in an aluminum pan, and with an empty aluminum pan used as a reference, measurement is performed in a measurement temperature range of 30 to 200° C. at a temperature rise rate of 10° C./min. Incidentally, in the measurement, the temperature is once raised up to 200° C., subsequently lowered to 30° C., and thereafter, the temperature is raised again. In this second temperature rise, the maximum endothermic peak temperature of a DSC curve within the temperature range of 30 to 200° C. is obtained as a melting point, and the quantity of heat obtained based on the area of the peak is defined as the quantity of heat of fusion.

<Measurement of Tg of Polyester Resin>

The Tg of a polyester resin and a toner are measured according to ASTM D3418-82 by using a differential scanning calorimeter "Q2000" (manufactured by TA Instruments Inc.). For the temperature correction of a detection unit of the used apparatus, melting points of indium and zinc are used, and for correction of the quantity of heat, the heat of fusion of indium is used. Specifically, approximately 2 mg of a sample is precisely weighed and the weighed sample is put in an aluminum pan, and with an empty aluminum pan used as a reference, measurement is performed in a measurement range of 30 to 200° C. at a temperature rise rate of 10° C./min. Incidentally, in the measurement, the temperature is once raised up to 200° C., subsequently lowered to 30° C., and thereafter, the temperature is raised again. In this second temperature rise, change in specific heat is obtained in a temperature range of 40° C. to 100° C. A point of intersection of a differential thermal curve with a line passing through an intermediate point of a base line before and after occurrence of the change in specific heat is defined as a glass transition temperature Tg of the polyester resin or the toner.

<Measurement of Softening Points of Polyester Resin and Toner>

The softening points of a polyester resin and a toner are measured by using a constant-load extruding capillary rheometer, "flow properties evaluating apparatus, Flow Tester CFT-500D" (manufactured by Shimadzu Corporation) according to a manual accompanying the apparatus. In this apparatus, the temperature of a measurement sample filled in a cylinder is raised to melt the measurement sample while applying a constant load by a piston from above the measurement sample, and the molten measurement sample is extruded through a die disposed at the bottom of the cylinder, so as to obtain a flow curve corresponding to the relationship between the temperature and a descending level of the piston.

In the present invention, a "melting temperature obtained in ½ process" mentioned in the manual accompanying the "flow properties evaluating apparatus, Flow Tester CFT-500D" is set as the softening point. Incidentally, the melting temperature obtained in ½ process is a value calculated as follows: First, a value of ½ of a difference between a descending level Smax of the piston at the time point when the sample has completely flowed out and a descending level Smin of the piston at the time point when the sample has begun to flow out is obtained (which value is represented by X; X=(Smax−Smin)/2). Then, a temperature on the flow curve at the time point when the descending level of the piston is equal to a sum of X and Smin is defined as the melting temperature obtained in ½ process.

The measurement sample is a cylindrical sample with a diameter of approximately 8 mm, which is obtained by compression molding approximately 1.0 g of a sample by using a tablet compressing machine (such as NT-100H, manufactured by NPa System Co., Ltd.) at approximately 10 MPa for approximately 60 seconds under an environment of 25° C.

Conditions for the measurement with CFT-500D are as follows:

Test mode: Temperature rise method

Temperature rise rate: 4° C./min

Starting temperature: 50° C.

Ultimate temperature: 200° C.

<Measurement of Acid Value of Polyester Resin>

An acid value is a value in mg of potassium hydroxide necessary for neutralizing an acid contained in 1 g of a sample. The acid value of a polyester resin is measured according to JIS K 0070-1992, and specifically measured as follows.

(1) Preparation of Reagent

A phenolphthalein solution is obtained by dissolving 1.0 g of phenolphthalein in 90 ml of ethyl alcohol (95 vol %) and adding ion-exchanged water thereto to attain a total amount of 100 ml.

Seven g of special grade potassium hydroxide is dissolved in 5 ml of water, and ethyl alcohol (95 vol %) is added thereto to attain a total amount of 1 l. The resulting solution is put in an alkali-resisting vessel so as not to come into contact with a carbon dioxide gas and the like, and left to stand for 3 days, and the resulting solution is filtered to give a potassium hydroxide solution. The thus obtained potassium hydroxide solution is stored in an alkali-resisting vessel. The factor of the potassium hydroxide solution is obtained as follows: Twenty five ml of 0.1 mol/l hydrochloric acid is put in an Erlenmeyer flask, several drops of the phenolphthalein solution were added thereto, the resulting solution was titrated with the potassium hydroxide solution, and the factor is obtained based on the amount of the potassium hydroxide solution necessary for neutralization. The 0.1 mol/l hydrochloric acid is prepared according to JIS K 8001-1998 for use.

(2) Operation (A) Run Proper

A sample of a ground polyester resin is precisely weighed in an amount of 2.0 g and the weighed sample is put in a 200 ml Erlenmeyer flask, 100 ml of a mixed solution of toluene/ethanol (2:1) is added thereto, and the sample is dissolved therein over 5 hours. Subsequently, several drops of the phenolphthalein solution are added as an indicator, and the resulting solution is titrated with the potassium hydroxide solution. The end point of the titration is determined as a time point when a pale red color of the indicator has continued for approximately 30 seconds.

(B) Blank Test

The titration is performed in the same manner as described above except that a sample is not used (namely, the mixed solution of toluene/ethanol (2:1) alone is used).

(3) An acid value is calculated by substituting the obtained result in the following expression:

$$A=[(C-B)\times f\times 5.61]/S$$

wherein A represents an acid value (mg KOH/g), B represents the amount (ml) of the potassium hydroxide solution added in the blank test, C represents the amount (ml) of the potassium hydroxide solution added in the run proper, f represents the factor of the potassium hydroxide solution, and S represents the weight (g) of the sample.

<Measurement of Hydroxyl Value of Polyester Resin>

A hydroxyl value means a value in mg of potassium hydroxide necessary for neutralizing acetic acid bonded to a hydroxyl group in acetylating 1 g of a sample. The hydroxyl value of a polyester resin is measured according to JIS K 0070-1992, and specifically measured as follows.

(1) Preparation of Reagent

An acetylating reagent is obtained by putting 25 g of special grade acetic anhydride in a 100 ml measuring flask, adding pyridine thereto to attain a total amount of 100 ml, and sufficiently shaking the resulting solution. The thus obtained acetylating reagent is stored in a brown bottle so as not to come into contact with moisture, a carbon dioxide gas and the like.

A phenolphthalein solution is obtained by dissolving 1.0 g of phenolphthalein in 90 ml of ethyl alcohol (95 vol %) and adding ion-exchanged water thereto to attain a total amount of 100 ml.

Thirty five g of special grade potassium hydroxide is dissolved in 20 ml of water, and ethyl alcohol (95 vol %) is added thereto to attain a total amount of 1 l. The resulting solution is put in an alkali-resisting vessel so as not to come into contact with a carbon dioxide gas and the like, and left to stand for 3 days, and the resulting solution is filtered to give a potassium hydroxide solution. The thus obtained potassium hydroxide solution is stored in an alkali-resisting vessel. The factor of the potassium hydroxide solution is obtained as follows: Twenty five ml of 0.5 mol/l hydrochloric acid is put in an Erlenmeyer flask, several drops of the phenolphthalein solution are added thereto, the resulting solution is titrated with the potassium hydroxide solution, and the factor is obtained based on the amount of the potassium hydroxide solution necessary for neutralization. The 0.5 mol/l hydrochloric acid is prepared according to JIS K 8001-1998 for use.

(2) Operation (A) Run Proper

A sample of a ground polyester resin is precisely weighed in an amount of 1.0 g and the weighed sample is put in a 200 ml round flask, and 5.0 ml of the acetylating reagent is added thereto accurately with a whole pipette. At that time, if the sample is hard to dissolve in the acetylating reagent, a small amount of special grade toluene is added for dissolving.

With a small funnel placed on the mouth of the flask, the flask is heated with a bottom portion thereof of approximately 1 cm immersed in a glycerin bath at approximately 97° C. At this point, in order to prevent the neck of the flask from rising in the temperature due to the heat of the bath, thick paper having a round hole can be put on the base of the neck of the flask.

After 1 hour, the flask is taken out of the glycerin bath and left to stand to cool. After standing to cool, 1 ml of water is added through the funnel, and the flask is shook to hydrolyze the acetic anhydride. For further complete hydrolysis, the flask is heated again in a glycerin bath for 10 minutes. After standing to cool, the inner walls of the funnel and the flask are washed with 5 ml of ethyl alcohol.

Several drops of the phenolphthalein solution are added as an indicator, and the resulting solution is titrated with the potassium hydroxide solution.

Incidentally, the end point of the titration is determined as a time point when a pale red color of the indicator has continued for approximately 30 seconds.

(B) Blank Test

The titration is performed in the same manner as described above except that a sample of a polyester resin is not used.

(3) A hydroxyl value is calculated by substituting the obtained result in the following expression:

$$A=[\{(B-C)\times 28.05\times f\}/S]+D$$

wherein

A represents a hydroxyl value (mg KOH/g),

B represents the amount (ml) of the potassium hydroxide solution added in the blank test, C represents the amount (ml) of the potassium hydroxide solution added in the run proper, f represents the factor of the potassium hydroxide solution, S represents the weight (g) of the sample, and D represents an acid value (mg KOH/g) of the polyester resin.

<Measurement Method for Weight Average Particle Size (D4)>

The weight average particle size (D4) of a toner is calculated through analysis of measurement data obtained by measurement with 25000 effective measurement channels by using a precision particle size distribution measuring apparatus equipped with a 100 μm aperture tube and employing an aperture electric resistance method, "Coulter Counter Multisizer 3" (registered trademark, manufactured by Beckman Coulter, Inc.) and accompanying dedicated software for setting measurement conditions and analyzing measurement data, "Beckman Coulter Multisizer 3 Version 3.51" (manufactured by Beckman Coulter, Inc.).

As an aqueous electrolyte solution for used in the measurement, one obtained by dissolving special grade sodium chloride in ion-exchanged water into a concentration of approximately 1% by mass, such as "ISOTON II" (manufactured by Beckman Coulter, Inc.), can be used.

Incidentally, before the measurement and analysis, the dedicated software is set as follows.

In a "screen for changing standard operation method (SOM)" of the dedicated software, the total count number in the control mode is set to 50000 particles, the number of measurements is set to one, and a Kd value is set to a value obtained by using "standard particles of 10.0 μm" (Beckman Coulter, Inc.). A threshold value and noise level are automatically set by pressing a threshold value/noise level measurement button. In addition, the current is set to 1600 μA, the gain is set to 2, the aqueous electrolyte solution is set to ISOTON II, and a check is put in an item of aperture tube flush to be performed after the measurement.

In a "screen for setting conversion from pulses to particle size" of the dedicated software, a bin interval is set to logarithmic particle size, the number of particle size bins is set to 256, and a particle size range is set to 2 μm to 60 μm.

The measurement method is specifically performed as follows.

(1) Approximately 200 ml of the above-described aqueous electrolyte solution is put in a 250 ml round bottom glass beaker intended for use with Multisizer 3 and the beaker is placed in a sample stand and counterclockwise stirring with a stirrer rod is carried out at 24 rotations per second. Contamination and air bubbles within the aperture tube have precedently been removed by an "aperture flush" function of the analysis software.

(2) Approximately 30 ml of the above-described aqueous electrolyte solution is put in a 100 ml flat bottom glass beaker, and to this beaker, approximately 0.3 ml of a dilution prepared by three-fold by mass dilution with ion-exchanged water of "Contaminon N" (a 10 mass % aqueous solution of a neutral pH 7 detergent for cleaning precision measurement instruments, containing a nonionic surfactant, an anionic surfactant and an organic builder, manufactured by Wako Pure Chemical Industries, Ltd.) is added as dispersant.

(3) In an "Ultrasonic Dispersion System Tetora 150" (Nikkaki Bios Co., Ltd.), that is, an ultrasonic disperser with an electrical output of 120 W equipped with two oscillators of oscillation frequency of 50 kHz disposed with their phases displaced by 180°, a prescribed amount of ion-exchanged water is introduced into a water tank of the ultrasonic disperser and approximately 2 ml of the Contaminon N is added to the water tank.

(4) The beaker described in the item (2) is set into a beaker holder hole of the ultrasonic disperser and the ultrasonic disperser is started. The height of the beaker is adjusted in such a manner that the resonant state of the surface of the aqueous electrolyte solution within the beaker is at the maximum level.

(5) With the aqueous electrolyte solution within the beaker set as described in the item (4) irradiated with ultrasonic waves, approximately 10 mg of toner is added to the aqueous electrolyte solution in small aliquots to be dispersed therein. The ultrasonic dispersion treatment is continued for another 60 seconds. Incidentally, the water temperature in the water tank is appropriately controlled during the ultrasonic dispersion to be 10° C. or more and 40° C. or less.

(6) The aqueous electrolyte solution containing the dispersed toner as described in the item (5) is added, by using a pipette, dropwise into the round bottom beaker set in the sample stand as described in the item (1) so as to make adjustment for attaining a measurement concentration of approximately 5%. The measurement is then performed until the number of measured particles reaches 50000.

(7) The measurement data is analyzed by the above-described dedicated software accompanying the apparatus, and the weight average particle size (D4) is calculated. Incidentally, an "average size" shown in an analysis/volume statistical value (arithmetic mean) screen with graph/volume % set in the dedicated software corresponds to the weight average particle size (D4).

EXAMPLES

The basic structure and characteristics of the present invention have been described so far, and the present invention will now be specifically described based on examples. It is noted that embodiments of the present invention are not limited at all by the following description. In the examples described below, a term "part(s)" is used in mass basis.

<Production Example of Polyester Resin A>

<Production Example of Resin A1-1>

A reaction vessel equipped with a nitrogen introducing tube, a dehydrating tube, a stirrer and a thermocouple was charged with 1,10-decanediol used as an alcohol monomer and 1,10-decanedioic acid used as an acid monomer in amounts shown in Table 1.

Then, tin dioctylate was added as a catalyst in an amount of 1 part by mass based on 100 parts by mass of the total amount of the monomers, and the resulting solution was heated to 140° C. under a nitrogen atmosphere so as to carry out a reaction under normal pressure for 6 hours with water distilled off.

Subsequently, the reaction was carried out while raising the temperature to 200° C. at 10° C./hr., and after performing the reaction for 2 hours after reaching the temperature of 200° C., the pressure within the reaction vessel was reduced to 5 kPa or less, and the reaction was carried out for 3.5 hours at 200° C. Thereafter, the pressure within the reaction vessel was gradually released to be restored to the normal pressure, a crystal nucleating agent (n-octadecanoic acid) shown in Table 1 was added thereto in a content shown in the table, and the reaction was carried out at 210° C. under the normal pressure for 2 hours. Then, the pressure within the reaction vessel was reduced again to 5 kPa or less, and the reaction was carried out at 190° C. for 3 hours, and thus, a resin A1-1 was obtained. In a mass spectrum of the thus obtained resin A1-1 measured by using MALDI-TOFMS, a peak derived from a composition containing n-octadecanoic acid bonded to a molecular end of the resin A-1 was found, and therefore, it was confirmed that the crystal nucleating agent was bonded to the molecular end of the resin A-1. The physical properties of the thus obtained polyester resin A1-1 are shown in Table 2.

<Production Example of Polyester Resins A1-2 to A12>

Polyester resins A1-2, A1-3 and A2 to A12 were obtained in the same manner as the polyester resin A1-1 except that monomer species, contents thereof and crystal nucleating agents were changed as shown in Table 1. The thus obtained resins A1-2, A1-3, polyesters A2 to A9, A11 and A12 were measured for mass spectra by using MALDI-TOFMS, resulting in finding peaks derived from the compositions containing the crystal nucleating agents bonded to the ends of polyester resin portions and confirming that the crystal nucleating agents were bonded to the molecular ends.

The physical properties of the thus obtained resins A1-2, A1-3 and polyester resins A2 to A12 are shown in Table 2.

TABLE 1

| | Monomer composition | | | | | | | |
|---|---|---|---|---|---|---|---|---|
| | Alcohol component | SP value | Molar ratio | Acid component | SP value | Molar ratio | Crystal nucleating agent | Molar ratio |
| Polyester resin A1-1 | 1,10-decanediol | 9.84 | 100.0 | 1,10-decanedioic acid | 9.97 | 100.0 | n-ocatadecanoic acid | 4.0 |
| Polyester resin A1-2 | 1,10-decanediol | 9.84 | 100.0 | 1,10-decanedioic acid | 9.97 | 100.0 | n-ocatadecanoic acid | 0.3 |
| Polyester resin A1-3 | 1,10-decanediol | 9.84 | 100.0 | 1,10-decanedioic acid | 9.97 | 100.0 | n-ocatadecanoic acid | 7.0 |
| Polyester resin A2 | 1,10-decanediol | 9.84 | 100.0 | 1,7-heptanedioic acid | 10.71 | 100.0 | n-ocatadecanoic acid | 4.0 |
| Polyester resin A3 | 1,10-decanediol | 9.84 | 100.0 | 1,7-heptanedioic acid | 10.71 | 100.0 | n-octacosanoic acid | 4.0 |
| Polyester resin A4 | 1,10-decanediol | 9.84 | 100.0 | 1,7-heptanedioic acid | 10.71 | 100.0 | n-octanoic acid | 4.0 |
| Polyester resin A5 | 1,10-decanediol | 9.84 | 100.0 | 1,7-heptanedioic acid | 10.71 | 100.0 | n-dotriacontanoic acid | 4.0 |
| Polyester resin A6 | 1,10-decanediol | 9.84 | 100.0 | 1,7-heptanedioic acid | 10.71 | 100.0 | n-dodecanoic acid | 4.0 |
| Polyester resin A7 | 1,9-nonanediol | 10.02 | 100.0 | 1,6-hexanedioic acid | 11.10 | 100.0 | n-ocatadecanoic acid | 4.0 |
| Polyester resin A8 | 1,6-hexanediol | 10.83 | 100.0 | 1,6-hexanedioic acid | 11.10 | 100.0 | n-ocatadecanoic acid | 4.0 |
| Polyester resin A9 | 1,12-dodecanediol | 9.57 | 100.0 | 1,14-tetradecanedioic acid | 9.44 | 100.0 | n-ocatadecanoic acid | 4.0 |

TABLE 1-continued

| | Monomer composition | | | | | | | |
|---|---|---|---|---|---|---|---|---|
| | Alcohol component | SP value | Molar ratio | Acid component | SP value | Molar ratio | Crystal nucleating agent | Molar ratio |
| Polyester resin A10 | 1,10-decanediol | 9.84 | 100.0 | 1,10-decanedioic acid | 9.97 | 100.0 | — | 4.0 |
| Polyester resin A11 | 1,9-nonanediol | 10.02 | 100.0 | 1,5-pentanedioic acid | 11.62 | 100.0 | n-ocatadecanoic acid | 4.0 |
| Polyester resin A12 | 1,16-hexadecanediol | 9.21 | 100.0 | 1,16-hexadecanedioic acid | 9.27 | 100.0 | n-ocatadecanoic acid | 0.0 |

TABLE 2

| | Physical properties | | | | |
|---|---|---|---|---|---|
| | SP value $(cal/cm^3)^{1/2}$ | ΔH J/g | Softening point ° C. | Acid value mgKOH/g | Hydroxyl value mgKOH/g |
| Polyester resin A1-1 | 9.91 | 126 | 78 | 2 | 14 |
| Polyester resin A1-2 | 9.91 | 123 | 79 | 2 | 19 |
| Polyester resin A1-3 | 9.91 | 128 | 76 | 2 | 8 |
| Polyester resin A2 | 10.28 | 113 | 71 | 3 | 16 |
| Polyester resin A3 | 10.28 | 112 | 69 | 2 | 15 |
| Polyester resin A4 | 10.28 | 111 | 73 | 3 | 14 |
| Polyester resin A5 | 10.28 | 114 | 65 | 3 | 15 |
| Polyester resin A6 | 10.28 | 115 | 75 | 3 | 16 |
| Polyester resin A7 | 10.56 | 132 | 69 | 2 | 15 |
| Polyester resin A8 | 10.97 | 130 | 65 | 3 | 15 |
| Polyester resin A9 | 9.51 | 135 | 87 | 2 | 14 |
| Polyester resin A10 | 9.91 | 125 | 77 | 3 | 14 |
| Polyester resin A11 | 10.82 | 90 | 67 | 6 | 17 |
| Polyester resin A12 | 9.24 | 132 | 101 | 2 | 15 |

<Production Example of Polyester Resin B1>

A reaction vessel equipped with a nitrogen introducing tube, a dehydrating tube, a stirrer and a thermocouple was charged with monomers in blending amounts shown in Table 3, and dibutyltin was added thereto as a catalyst in an amount of 1.5 parts by mass based on 100 parts by mass of the total amount of the monomers.

Subsequently, an esterification reaction was carried out under conditions of a nitrogen atmosphere, the normal pressure and 260° C., and the reaction was completed when no water distilled. Thereafter, the temperature was kept at 220° C., the pressure within the vessel was reduced to 0.2 kPa, and a condensation reaction was carried out until the resin reached a desired softening point. When the desired softening point was reached, the pressure within the reaction vessel was restored to the normal pressure and the heating was stopped. The thus obtained reaction product was compressed with nitrogen and taken out of the vessel over approximately 2 hours, and thus, a resin B1 was obtained.

The physical properties of the thus obtained resin B1 are shown in Table 4.

Furthermore, a monomer ratio of a low molecular weight component in the resin was analyzed, resulting in finding that the resin contained 63.6 parts by mole of TPA, 3.4 parts by mole of TMA, 82.6 parts by mole of BPA-PO addition product, 24.9 parts by mole of BPA-EO addition product and 0.4 part by mole of EG. An SP value of the low molecular weight component calculated based on this composition ratio was 9.87 $(cal/cm^3)^{1/2}$.

<Production Example of Polyester Resin B2>

A polyester resin B2 was obtained in the same manner as the polyester resin B1 except that the monomer species and the contents thereof were changed as shown in Table 3. The physical properties of the thus obtained resin B2 are shown in Table 4. Furthermore, a monomer ratio of a low molecular weight component in the resin was analyzed, resulting in finding that the resin contained 63.6 parts by mole of TPA, 2.2 parts by mole of TMA, 1.1 parts by mole of FA, 53.3 parts by mole of BPA-PO addition product, 24.9 parts by mole of BPA-EO addition product and 2.3 parts by mole of EG. An SP value of the low molecular weight component calculated based on this composition ratio was 10.01 $(cal/cm^3)^{1/2}$.

<Production Example of Polyester Resin B3>

A polyester resin B3 was obtained in the same manner as the polyester resin B1 except that the monomer species and the contents thereof were changed as shown in Table 3. The physical properties of the thus obtained resin B3 are shown in Table 4. Furthermore, a monomer ratio of a low molecular weight component in the resin was analyzed, resulting in finding that the resin contained 63.6 parts by mole of TPA, 12.7 parts by mole of BPA-PO addition product, 7.1 parts by mole of BPA-EO addition product, 2.2 parts by mole of EG, 4.2 parts by mole of PG and 4.6 parts by mole of NPG. An SP value of the low molecular weight component calculated based on this composition ratio was 10.24 $(cal/cm^3)^{1/2}$.

<Production Example of Polyester Resin B4>

A polyester resin B4 was obtained in the same manner as the polyester resin B1 except that the monomer species and the contents thereof were changed as shown in Table 3. The physical properties of the thus obtained resin B4 are shown in Table 4. Furthermore, a monomer ratio of a low molecular weight component in the resin was analyzed, resulting in finding that the resin contained 58.3 parts by mole of TPA, 3.4 parts by mole of TMA, 76.2 parts by mole of BPA-PO addition product, 28.4 parts by mole of BPA-EO addition product and 0.7 part by mole of EG. An SP value of the low molecular weight component calculated based on this composition ratio was 9.87 $(cal/cm^3)^{1/2}$.

<Production Example of Polyester Resin B5>

A polyester resin B5 was obtained in the same manner as the polyester resin B2 except that condensation time was elongated for attaining a rather high softening point. The physical properties of the thus obtained resin B5 are shown in Table 4. Furthermore, a monomer ratio of a low molecular weight component in the resin was analyzed, resulting in finding that the resin contained 63.6 parts by mole of TPA, 4.5 parts by mole of TMA, 1.7 parts by mole of FA, 55.9 parts by mole of BPA-PO addition product, 25.6 parts by mole of BPA-EO addition product and 2.5 parts by mole of EG. An SP value of the low molecular weight component calculated based on this composition ratio was 10.03 $(cal/cm^3)^{1/2}$.

<Production Example of Polyester Resin B6>

A polyester resin B6 was obtained in the same manner as the polyester resin B1 except that condensation time was shortened for attaining a rather low softening point. The physical properties of the thus obtained resin B6 are shown in Table 4. Furthermore, a monomer ratio of a low molecular weight component in the resin was analyzed, resulting in finding that the resin contained 63.6 parts by mole of TPA, 3.4 parts by mole of TMA, 88.9 parts by mole of BPA-PO addition product, 21.3 parts by mole of BPA-EO addition product and 0.6 part by mole of EG. An SP value of the low molecular weight component calculated based on this composition ratio was 9.86 $(cal/cm^3)^{1/2}$.

<Production Example of Polyester Resin B7>

A reaction vessel equipped with a nitrogen introducing tube, a dehydrating tube, a stirrer and a thermocouple was charged with monomers in contents shown in Table 3, and dibutyltin was added thereto as a catalyst in an amount of 1.5 parts by mass based on 100 parts by mass of the total amount of the monomers.

Subsequently, the temperature was raised at a rate of 10° C./hr. under a nitrogen atmosphere at the normal pressure up to 220° C., at which an esterification reaction was carried out, and the reaction was completed when no water distilled. Thereafter, the temperature was kept at 220° C., the pressure within the vessel was reduced to 0.2 kPa, and a condensation reaction was carried out until the resin reached a desired softening point. When the desired softening point was reached, the pressure within the reaction vessel was restored to the normal pressure and the heating was stopped. The thus obtained reaction product was compressed with nitrogen and taken out of the vessel over approximately 2 hours, and thus, a resin B7 was obtained.

The physical properties of the thus obtained resin B7 are shown in Table 4.

In this production example, the kinds of the used monomers were largely changed, and hence, the resin B7 having a small area % of a molecular weight of 1500 or less was obtained.

A monomer ratio of a low molecular weight component in the resin was analyzed, resulting in finding that the resin contained 48.0 parts by mole of TPA, 3.3 parts by mole of EG, 4.2 parts by mole of PG and 5.3 parts by mole of NPG. An SP value of the low molecular weight component calculated based on this composition ratio was 10.49 $(cal/cm^3)^{1/2}$.

<Production Example of Polyester Resin B8>

A reaction vessel equipped with a nitrogen introducing tube, a dehydrating tube, a stirrer and a thermocouple was charged with monomers in contents shown in Table 3, and dibutyltin was added thereto as a catalyst in an amount of 1.5 parts by mass based on 100 parts by mass of the total amount of the monomers.

Subsequently, the temperature was rapidly raised to 180° C. under a nitrogen atmosphere at the normal pressure, and polycondensation was carried out with water distilled while heating from 180° C. to 200° C. at a rate of 10° C./hr.

When the temperature of 200° C. was achieved, the pressure within the reaction vessel was reduced to 10 kPa or less, and the polycondensation was carried out under conditions of 200° C. and 10 kPa or less, and thus, a resin B8 was obtained.

At that time, polymerization time was adjusted so that the resulting resin B8 could attain a softening point with a value shown in Table 4. The physical properties of the thus obtained resin B8 are shown in Table 4.

Furthermore, a monomer ratio of a low molecular weight component in the resin was analyzed, resulting in finding that the resin contained 49.5 parts by mole of TPA, 3.4 parts by mole of TMA, 94.3 parts by mole of BPA-PO addition product, 29.1 parts by mole of BPA-EO addition product and 0.6 part by mole of EG. An SP value of the low molecular weight component calculated based on this composition ratio was 9.81 $(cal/cm^3)^{1/2}$.

TABLE 3

| | Acid (part(s) by mol) | | | | Alcohol (part(s) by mol) | | | | |
|---|---|---|---|---|---|---|---|---|---|
| Monomer species | TPA | IPA | TMA | FA | EPA- PO | EPA- EO | EG | PG | NPG |
| SP value | 10.28 | 10.28 | 11.37 | 12.83 | 9.51 | 9.74 | 14.11 | 12.70 | 8.37 |
| Polyester resin B1 | 120 | 0 | 6 | 0 | 65 | 35 | 4 | 0 | 0 |
| Polyester resin B2 | 120 | 0 | 4 | 2 | 42 | 35 | 21 | 0 | 0 |
| Polyester resin B3 | 120 | 0 | 0 | 0 | 10 | 10 | 20 | 35 | 35 |
| Polyester resin B4 | 110 | 0 | 6 | 0 | 60 | 40 | 6 | 0 | 0 |
| Polyester resin B5 | 120 | 0 | 8 | 3 | 44 | 36 | 23 | 0 | 0 |
| Polyester resin B6 | 120 | 0 | 6 | 0 | 70 | 30 | 5 | 0 | 0 |
| Polyester resin B7 | 100 | 0 | 0 | 0 | 0 | 0 | 25 | 30 | 35 |
| Polyester resin B8 | 110 | 0 | 6 | 0 | 65 | 35 | 6 | 0 | 0 |

TPA: Terephthalic acid
IPA: Isophthalic acid
TMA: Trimellitic acid
FA: Fumaric acid
BPA-PO: Addition product of bisphenol A and 2 mol propylene oxide
BPA-EO: Addition product of bisphenol A and 2 mol ethylene oxide
EG: Ethylene glycol
PG: 1,3-propylene glycol
NPG: neopentyl glycol

TABLE 4

| | SP value $(cal/cm^3)^{1/2}$ | Weight average molecular weight Mwb | Number average molecular weight Mnb | Ratio of molecular weight of 1500 or less area % | Tg ° C. | Softening point ° C. | Acid value mgKOH/g | Hydroxyl value mgKOH/g |
|---|---|---|---|---|---|---|---|---|
| Polyester resin B1 | 10.08 | 5120 | 2050 | 10.2 | 54 | 100 | 2 | 55 |
| Polyester resin B2 | 10.45 | 5642 | 2265 | 9.2 | 55 | 94 | 7 | 58 |
| Polyester resin B3 | 10.63 | 7012 | 3215 | 5.2 | 50 | 97 | 10 | 60 |

TABLE 4-continued

| | SP value $(cal/cm^3)^{1/2}$ | Weight average molecular weight Mwb | Number average molecular weight Mnb | Ratio of molecular weight of 1500 or less area % | Tg ° C. | Softening point ° C. | Acid value mgKOH/g | Hydroxyl value mgKOH/g |
|---|---|---|---|---|---|---|---|---|
| Polyester resin B4 | 10.11 | 5412 | 2153 | 7.3 | 55 | 92 | 3 | 53 |
| Polyester resin B5 | 10.50 | 7841 | 2854 | 8.5 | 58 | 102 | 5 | 55 |
| Polyester resin B6 | 10.09 | 4852 | 2010 | 12.3 | 52 | 80 | 4 | 59 |
| Polyester resin B7 | 10.81 | 6984 | 3321 | 0.5 | 51 | 93 | 9 | 60 |
| Polyester resin B8 | 10.10 | 5641 | 2090 | 15.6 | 52 | 93 | 4 | 57 |

Example 1

| | |
|---|---|
| Polyester resin A1 | 20.0 parts by mass |
| Polyester resin B1 | 80.0 parts by mass |
| Carbon black | 5.0 parts by mass |
| Fischer-Tropsch wax (DSC peak temperature 105° C.) | 5.0 parts by mass |
| Aluminum 3,5-di-t-butylsalicylate compound | 0.5 part by mass |

The above-described materials were mixed by using a Henschel mixer (FM-75, manufactured by Mitsui Miike Chemical Engineering Machinery Co., Ltd.), and the resulting mixture was kneaded by using a double-screw kneader (manufactured by Ikegai Ltd., PCM-30) under conditions of a rotation speed of 3.3 $s^{-1}$ and a kneading temperature of 110° C.

The thus kneaded product was cooled, and roughly ground by using a hammer mill into a size of 1 mm or less to give a roughly ground product. The roughly ground product was finely ground by using a mechanical grinder (manufactured by Turbo Kogyo Co., Ltd., T-250). The thus obtained finely ground powder was classified by using a multiple classifier employing Coanda effect, thereby obtaining negatively chargeable toner particles with a weight average particle size of 7.0 μm.

To 100 parts by mass of the obtained toner particles, 1.0 part by mass of titanium oxide fine particles, which had been surface treated with 15 mass % isobutyl trimethoxysilane and had an average particle size of primary particles of 50 nm, and 0.8 part by mass of hydrophobic silica fine particles, which had been surface treated with 20 mass % hexamethyldisilazane and had an average particle size of primary particles of 16 nm, were added, and the resulting mixture was mixed by using a Henschel mixer (manufactured by Mitsui Miike Chemical Engineering Machinery Co., Ltd., FM-75), thereby obtaining a toner 1.

The softening point of the thus obtained toner 1 is shown in Table 5.

In this example, as a machine for evaluating the fixing property and the long-term storage stability of the obtained toner 1, a commercially available color laser printer, Color Laser Jet CP4525 (manufactured by HP) was used. In this evaluation machine, a toner was changed to the toner 1 produced in the present example so as to make evaluations as follows.

(1) High Speed Fixing Property

A fixer of the commercially available color laser printer, Color Laser Jet CP4525 (manufactured by HP) was taken out, and an external fixer in which a fixing temperature, a fixing nip pressure and a process speed for a fixing apparatus could be arbitrarily set was used instead.

Under an environment of a temperature of 23° C. and relative humidity of 50%, color laser copier paper (manufactured by Cannon Inc., 80 $g/m^2$) was used, and a black cartridge was used for the evaluation. Specifically, a product toner was extracted from a commercially available black cartridge, the inside of the cartridge was cleaned by air blow and then the cartridge was filled with 150 g of the toner 1 of the present invention for the evaluation. Incidentally, in respective stations for magenta, yellow and cyan, magenta, yellow and cyan cartridges from which product toners had been extracted and for which a toner residual amount detecting mechanism was disabled were inserted for making the evaluation. Thereafter, an unfixed black image was output so as to attain a toner carrying amount of 0.6 $mg/cm^2$.

With the fixing temperature of the fixer set to 150° C., the process speed was increased in a range from 300 mm/sec to 500 mm/sec by 20 mm/sec, so as to fix the unfixed black image. Each of the thus obtained black images was rubbed through 5 reciprocations by using lens-cleaning paper with a load of approximately 100 g applied, and a point where a ratio of density decrease of the image resulting from the rubbing was 10% or less was set as the maximum fixable process speed. As this speed is higher, the toner is better in the low temperature fixing property (the high speed fixing property).

The result of the evaluation is shown in Table 6.

A: The fixing speed is 400 mm/sec or more.

B: The fixing speed is 350 mm/sec or more and less than 400 mm/sec.

C: The fixing speed is 300 mm/sec or more and less than 350 mm/sec.

D: The fixing speed is less than 300 mm/sec.

(2) Low Pressure Fixing Property

In the aforementioned fixing test, with the fixing temperature of the fixer set to 150° C., the fixing nip pressure was increased in a range from 0.08 MPa to 0.24 MPa by 0.02 MPa, so as to fix the unfixed black image. Each of the thus obtained black images was rubbed through 5 reciprocations by using lens-cleaning paper with a load of approximately 100 g applied, and a point where a ratio of density decrease of the image resulting from the rubbing was 10% or less was set as the fixing nip surface pressure. As the fixing nip surface pressure is lower, the toner is better in the low temperature fixing property (low pressure fixing property). The result of the evaluation is shown in Table 6.

A: The fixing nip surface pressure is less than 0.10 MPa.

B: The fixing nip surface pressure is 0.10 MPa or more and less than 0.14 MPa.

C: The fixing nip surface pressure is 0.14 MPa or more and less than 0.20 MPa.

D: The fixing nip surface pressure is 0.20 MPa or more.

(3) Long-Term Storage Stability in High Temperature Environment (Curling Property Evaluation)

In the aforementioned fixing test, the unfixed black image was fixed at a fixing temperature of 150° C., at a fixing nip pressure of 0.25 MPa and at a process speed of 200 mm/sec. The thus obtained black image is left to stand for 30 days in an environmental test laboratory at a temperature of 40° C. and relative humidity of 50%. After leaving to stand, the image was placed on a flat table with its one longitudinal side fixed thereon with a tape. Here, an angle formed when the other side curled up was measured for evaluating the curling property. For calculating the angle, an angle between a straight line connecting the curled tip of the paper and a contact point with the table to each other and the surface of the flat table was obtained.

As the angle is smaller, it can be said that the long-term storage property under a high temperature environment is better. The result of the evaluation is shown in Table 6.

A: Less than 10%.

B: 10% or more and less than 20%.

C: 20% or more and less than 30%.

D: 30% or more and less than 40%.

E: 40% or more.

(4) Test for Fixing Property on Thick Paper

A fixer of a commercially available color laser printer, Color Laser Jet CP4525 (manufactured by HP) was taken out, and an external fixer in which a fixing temperature, a fixing nip pressure and a process speed for a fixing apparatus could be arbitrarily set was used instead.

Under an environment of a temperature of 23° C. and relative humidity of 50%, thick paper GF-C104 (manufactured by Cannon Inc., 104 g/m$^2$) was used, and a black cartridge was used for the evaluation. Specifically, a product toner was extracted from a commercially available black cartridge, the inside of the cartridge was cleaned by air blow and then the cartridge was filled with 150 g of the toner 1 of the present invention for the evaluation. Incidentally, in respective stations for magenta, yellow and cyan, magenta, yellow and cyan cartridges from which product toners had been extracted and for which a toner residual amount detecting mechanism was disabled were inserted for making the evaluation. Thereafter, an unfixed black image was output so as to attain a toner carrying amount of 0.6 mg/cm$^2$.

With a process speed set to 200 mm/sec and a fixing nip pressure set to 0.25 MPa, the fixing temperature of the fixer was changed by 10° C. from 100° C. to 200° C., so as to fix the unfixed image at each fixing temperature.

Each of the thus obtained black images was rubbed through 5 reciprocations by using lens-cleaning paper with a load of approximately 100 g applied, and a temperature at which a ratio of density decrease of the image resulting from the rubbing was 10% or less was set as a fixing temperature. The fixing property was evaluated based on the following criteria. The result of the evaluation is shown in Table 6.

A: The fixing temperature is lower than 120° C.

B: The fixing temperature is 120° C. or more and lower than 130° C.

C: The fixing temperature is 130° C. or more and lower than 140° C.

D: The fixing temperature is 140° C. or more and lower than 150° C.

E: The fixing temperature is 150° C. or more.

(5) Test for Glossiness Unevenness of Fixed Image on Thick Paper

In the aforementioned fixing test, the thick paper GF-C104 (manufactured by Cannon Inc., 104 g/m$^2$) was used, so as to measure glossiness (%) of an image formed at a fixing temperature of 150° C., a fixing nip pressure of 0.25 MPa and a process speed of 200 mm/sec.

The measurement of the glossiness (gloss) was performed by using a handy glossmeter PG-1 (manufactured by Nippon Denshoku Industries Co., Ltd.). In the measurement, the incident angle and the reflection angle were set to 75°. The glossiness (gloss) of the image was measured in ten points on the output image, and a difference between the maximum gloss and the minimum gloss was used for evaluation of the glossiness unevenness. The evaluation was performed based on the following criteria. The result of the evaluation is shown in Table 6.

A: The difference in gloss is less than 2%.

B: The difference in gloss is 2% or more and less than 5%.

C: The difference in gloss is 5% or more and less than 7%.

D: The difference in gloss is 7% or more and less than 10%.

E: The difference in gloss is 10% or more.

In all the evaluations described above, the toner of Example 1 showed good results.

Examples 2 to 15

Toners 2 to 15 were obtained in the same manner as in Example 1 except that compositions shown in Table 5 were employed. The softening points of the toners 2 to 15 are shown in Table 5. Furthermore, the toners were evaluated in the same manner as in Example 1. The obtained results are shown in Table 6.

Comparative Examples 1 to 5

Toners 16 to 20 were obtained in the same manner as in Example 1 except that the compositions were changed as shown in Table 5. The softening point of the thus obtained toners 16 to 20 are shown in Table 5. Furthermore, the toners were evaluated in the same manner as in Example 1. The obtained results are shown in Table 6.

TABLE 5

| | Polyester resin A | Polyester resin B | A:B | Tm ° C. |
|---|---|---|---|---|
| Toner 1 | A1-1 | B1 | 20:80 | 98 |
| Toner 2 | A1-2 | B1 | 20:80 | 98 |
| Toner 3 | A1-3 | B1 | 20:80 | 97 |
| Toner 4 | A2 | B1 | 15:85 | 98 |
| Toner 5 | A3 | B1 | 15:85 | 97 |
| Toner 6 | A4 | B1 | 15:85 | 98 |
| Toner 7 | A5 | B1 | 10:90 | 98 |
| Toner 8 | A6 | B1 | 30:70 | 98 |
| Toner 9 | A7 | B2 | 5:95 | 95 |
| Toner 10 | A7 | B3 | 20:80 | 96 |
| Toner 11 | A1-1 | B2 | 5:95 | 95 |
| Toner 12 | A7 | B1 | 5:95 | 100 |
| Toner 13 | A8 | B2 | 10:90 | 93 |
| Toner 14 | A9 | B1 | 10:90 | 101 |
| Toner 15 | A7 | B4 | 6:94 | 93 |
| Toner 16 | A5 | B5 | 4:96 | 102 |
| Toner 17 | A9 | B6 | 45:55 | 87 |
| Toner 18 | A10 | B1 | 20:80 | 97 |
| Toner 19 | A11 | B1 | 20:80 | 95 |
| Toner 20 | A12 | B1 | 20:80 | 102 |
| Toner 21 | A1-1 | B7 | 20:80 | 92 |
| Toner 22 | A7 | B8 | 20:80 | 90 |

TABLE 6

| | | High speed fixing property (Fixing speed) | Low pressure fixing property (Fixing pressure) | Long-term storage stability (Curing angle) | Fixing property on thick paper (Fixing temperature) | Glossiness unevenness (Difference in gloss) |
|---|---|---|---|---|---|---|
| Example 1 | Toner 1 | A(420) | A(0.08) | A(0) | A(110) | A(1.5) |
| Example 2 | Toner 2 | A(420) | A(0.08) | B(10) | A(110) | A(1.5) |
| Example 3 | Toner 3 | B(360) | A(0.08) | A(0) | A(110) | A(1.5) |
| Example 4 | Toner 4 | A(400) | A(0.08) | A(3) | A(110) | A(1.5) |
| Example 5 | Toner 5 | A(400) | A(0.08) | B(10) | A(110) | B(2.2) |
| Example 6 | Toner 6 | A(400) | A(0.08) | B(10) | A(110) | A(1.8) |
| Example 7 | Toner 7 | A(400) | A(0.09) | B(10) | A(110) | B(2.9) |
| Example 8 | Toner 8 | A(400) | A(0.09) | B(15) | A(110) | A(1.7) |
| Example 9 | Toner 9 | A(400) | B(0.10) | A(3) | A(110) | B(2.4) |
| Example 10 | Toner 10 | B(360) | A(0.09) | A(3) | C(130) | B(2.6) |
| Example 11 | Toner 11 | A(420) | C(0.14) | A(3) | A(110) | B(2.8) |
| Example 12 | Toner 12 | A(400) | B(0.10) | C(20) | A(110) | B(2.4) |
| Example 13 | Toner 13 | A(400) | A(0.09) | C(25) | B(120) | B(3.5) |
| Example 14 | Toner 14 | C(340) | C(0.18) | B(10) | C(130) | A(1.8) |
| Example 15 | Toner 15 | B(360) | B(0.10) | C(25) | C(130) | A(1.5) |
| Example 16 | Toner 16 | A(400) | C(0.18) | A(3) | C(130) | C(5.8) |
| Example 17 | Toner 17 | C(340) | C(0.14) | C(25) | A(110) | C(6.5) |
| Comparative Example 1 | Toner 18 | A(400) | A(0.09) | D(35) | A(110) | A(1.4) |
| Comparative Example 2 | Toner 19 | A(400) | A(0.09) | D(30) | A(110) | A(1.6) |
| Comparative Example 3 | Toner 20 | D(240) | D(0.22) | A(3) | C(130) | A(1.5) |
| Comparative Example 4 | Toner 21 | D(240) | D(0.20) | A(3) | D(140) | C(6.4) |
| Comparative Example 5 | Toner 22 | A(400) | A(0.09) | B(10) | A(110) | D(8.2) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-141033, filed Jun. 22, 2012, which is hereby incorporated by reference herein in its entirety.

What is claimed is:

1. A toner comprising toner particles, each of which contains a polyester resin A, a polyester resin B and a colorant, wherein the polyester resin A has a polyester portion having a crystalline structure and a crystal nucleating agent portion, which is bonded to an end of the polyester portion, the crystal nucleating agent portion is formed by reacting (i) a compound having a hydrocarbon segment as a principal chain and having one functional group reactive with the end of the polyester portion, with (ii) the end of the polyester portion, the polyester resin B is a resin which does not possess a crystalline structure, in a chart obtained by measuring a molecular weight distribution of a tetrahydrofuran (THF)-soluble matter of the polyester resin B by gel permeation chromatography (GPC), a ratio of a component having a molecular weight of 1500 or less is 5.0% by area or more and 15.0% by area or less, and when an SP value of the polyester portion of the polyester resin A is represented by Sa $((cal/cm^3)^{1/2})$ and an SP value of the polyester resin B is represented by Sb $((cal/cm^3)^{1/2})$, the SP values Sa and Sb satisfy the following relationships:

$$9.50 \leq Sa \leq 11.00$$

$$-0.65 \leq Sb - Sa \leq 0.70.$$

2. The toner according to claim 1, wherein a mass-based content ratio between the polyester resin A and the polyester resin B in the toner particles is 5:95 to 40:60.

3. The toner according to claim 1, wherein the crystal nucleating agent portion is derived from at least one compound selected from the group consisting of aliphatic carboxylic acids having 10 or more and 30 or less carbon atoms and aliphatic alcohols having 10 or more and 30 or less carbon atoms.

4. The toner according to claim 1, wherein when a softening point of the polyester resin A is represented by TmA (° C.) and a softening point of the polyester resin B is represented by TmB (° C.), the softening points TmA and TmB satisfy the following relationships:

$$-10 \leq TmB - TmA \leq 40$$

$$60 \leq TmA \leq 90.$$

5. The toner according to claim 1, wherein the value Sa is 9.50 or more and 10.70 or less.

6. The toner according to claim 1, wherein the value Sa and the value Sb satisfy the following relationship:

$$-0.55 \leq Sb - Sa \leq 0.70.$$

7. The toner according to claim 1, wherein the polyester resin B contains the component having a molecular weight of 1500 or less in a ratio of 9.0% by area or more and 13.0% by area or less in the chart obtained by measuring the molecular weight distribution of the tetrahydrofuran (THF)-soluble matter of the polyester resin B by the gel permeation chromatography (GPC).

8. The toner according to claim 1, wherein when an SP value of the component having a molecular weight of 1500 or less contained in the polyester resin B is represented by Sc, the value Sa and the value Sc satisfy the following relationship:

$$-0.50 \leq Sa - Sc \leq 0.50.$$

9. The toner according to claim 1, wherein the polyester resin A has a quantity of heat of fusion (ΔH), which is obtained based on an area of an endothermic peak observed in temperature rise in measurement with a differential scanning calorimeter (DSC), of 100 J/g or more and 140 J/g or less.

10. The toner according to claim 4, wherein the softening point TmA (° C.) is 70° C. or more and 85° C. or less.

11. The toner according to claim 4, wherein the softening point TmB (° C)is 80° C. or more and 130° C. or less.

* * * * *